United States Patent [19]

Egashira

[11] 4,007,562

[45] Feb. 15, 1977

[54] GRINDING APPARATUS FOR COMMUTATORS

[76] Inventor: Hiroji Egashira, 6-25, 6-chome, Shinmachi, Hoya, Tokyo, Japan

[22] Filed: Jan. 12, 1976

[21] Appl. No.: 648,742

[30] Foreign Application Priority Data

Sept. 26, 1975 Japan ..... 50-116854
Nov. 14, 1975 Japan ..... 50-136837

[52] U.S. Cl. ..... 51/244
[51] Int. Cl.[2] ..... B24B 19/00
[58] Field of Search ..... 51/244, 251, 252, 253, 51/255, 241 R, 241 S, 241 US; 90/12 C

[56] References Cited

UNITED STATES PATENTS

| | | | |
|---|---|---|---|
| 841,541 | 1/1907 | Kramer | 51/255 |
| 991,996 | 5/1911 | Hunt | 51/244 |
| 1,292,177 | 1/1919 | Warther | 51/253 X |
| 1,395,880 | 11/1921 | Ward | 51/244 X |
| 1,881,410 | 10/1932 | Lintelmann | 51/244 |
| 1,935,805 | 11/1933 | Luft | 51/244 |
| 2,416,247 | 2/1947 | Wilcox | 51/241 VS |
| 2,741,078 | 4/1956 | Tenney | 51/244 |
| 3,849,946 | 11/1974 | Ogura | 51/244 |

*Primary Examiner*—James L. Jones, Jr.
*Assistant Examiner*—Nicholas P. Godici

[57] ABSTRACT

A grinding apparatus for reforming a surface of a commutator of a motor which has been worn or damaged, comprising a main spindle slidably movable in a guide sleeve as a housing of the apparatus, a cutting and feeding mechanism located at the back end of the main spindle for finely adjusting the grinding depth of a grinding stone arranged at the front end of the main spindle, and a clamping mechanism arranged on the guide sleeve for mounting the apparatus by forced engagement of the clamping mechanism in an opening of a casing of the motor for changing carbon brushes.

6 Claims, 15 Drawing Figures

GRINDING APPARATUS FOR COMMUTATORS

BACKGROUND OF THE INVENTION

1. Field of the Invention

This invention relates to a grinding apparatus and more particularly a grinding apparatus for reforming a surface of a commutator of an electric motor, which is adapted to be mounted for use at an opening of a casing of the motor for changing carbon brushes.

As a result of sliding contact of the commutator with carbon brushes over a long period of time, the surface of the commutator can be adversely affected by oxidation, spark discharge and the like, so that the surface is more or less damaged whereby its commutation is remarkably diminished and therefore it needs to be reformed to a smooth surface by grinding.

2. Description of the Prior Art

Various kinds of grinding apparatus have been suggested to date. For example, a main grinding spindle is supported by arms on supporting struts having bottom ends bolted to a coupling for a driving shaft of a motor, or a main spindle is supported on supporting struts fixed by a magnetic substance to one side of a casing of the motor. In this case, the damaged surface of the commutator is ground by a grinding stone held by an arm at the front end of the main grinding spindle while the commutator is rotating. These devices, however, have the disadvantages that the struts, arms and main spindle constitute a very long support which may give rise to a wandering of the apparatus and unavoidable chattering when grinding, and there is a tendency of the apparatus to change its initial position during operation, which makes it impossible to grind the surface of a commutator with a high accuracy.

SUMMARY OF THE INVENTION

The invention provides a grinding apparatus for commutators of electric motors which can overcome the above disadvantages in the prior art and one aspect of the invention comprises a main spindle having a grinding stone provided at its front end and slidably movable in a grindle sleeve, a grinding feeding mechanism arranged at a back end of the main spindle for finely adjusting the amount of grinding and a clamping mechanism directly provided on the guide sleeve for mounting the apparatus at an opening of a casing of the motor.

It is an object of the invention to provide a grinding apparatus for reforming surfaces of commutators, which is of light weight and compact, capable of performing assembling, disassembling and installing with ease and adapted to be applied to electric motors in a wide range of sizes.

It is another object of the invention to provide a grinding apparatus for commutators, wherein members having various performances are detachably provided on the axial line of a main grinding spindle for reforming the electrically rotating commutator by a grinding stone inserted at an opening of a casing of a motor.

It is further object of the invention to provide a grinding apparatus for commutators, comprising a manually operated grinding feeding mechanism located at the back end of a main spindle for finely and precisely adjusting the grinding depth and the feeding of a grinding stone relative to the surface of the commutator by manual operation.

It is another object of the invention to provide a grinding apparatus for commutators, comprising a clamping mechanism adapted to expandingly engage with an opening of a casing of a motor of the commutator in a plane perpendicular to a main spindle for installing the apparatus without occurrence of vibration and shift of initial position.

It is another object of the invention to provide a grinding apparatus for commutators, comprising arms pivotally mounted in a longitudinal direction by means of supporting rods perpendicular to a main spindle for mounting the apparatus in position properly and securely even though the surface of the commutator is adjacent to an opening of a casing of a motor of the commutator.

It is an additional object of the invention to provide a grinding apparatus for commutators, comprising a holder at the front end of a main spindle for positional and angular adjustments of a grinding stone to correct a positional error of the apparatus mounted at an opening of a casing of a motor of the commutator.

It is further additional object of the invention to provide a grinding apparatus capable of reforming all the surface of a long commutator by means of a transverse feeding mechanism for the grinding stone detachably provided on a holder at the front end of a main spindle.

BRIEF DESCRIPTION OF THE DRAWINGS

The invention will be more fully understood by referring to the following detailed description of a preferred embodiment which is illustrated in the accompanying drawings, in which:

FIG. 10 (*c*) is an end view taken on line D—D in FIG. 10 (*b*); and

DESCRIPTION OF THE PREFERRED EMBODIMENTS

Figure 1:
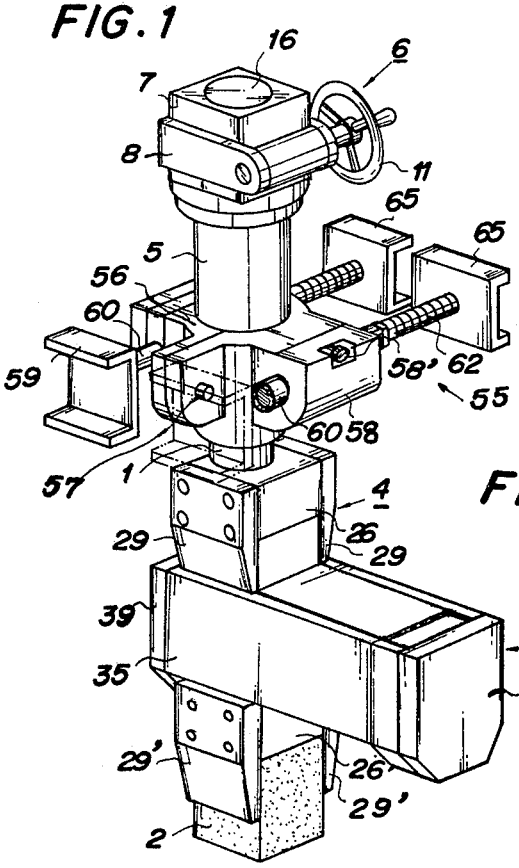
FIG. 1 is a perspective view, partially removed, of a grinding apparatus having a transverse feeding mechanism for a grinding stone, at the front end of a main spindle according to the invention.
Figure 4:
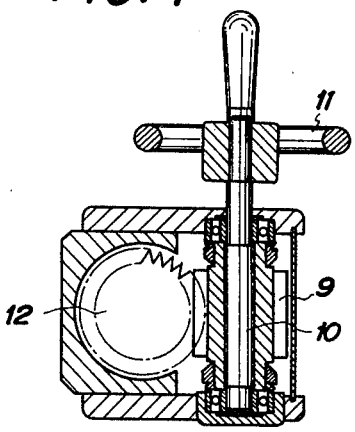
FIG. 4 is a sectional view taken along line A—A in FIG. 2.
Figure 5:
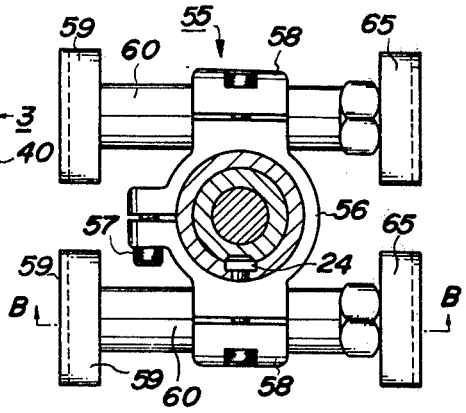
FIG. 5 is a sectional view taken on line C—C in FIG. 3.
Figure 6:
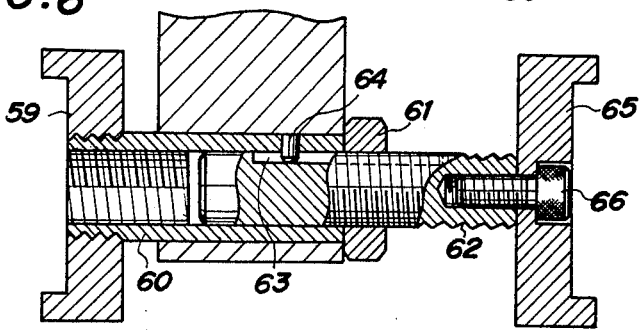
FIG. 6 is a sectional view of the apparatus taken along line B—B in FIG. 5.

Referring particularly to FIG. 1, reference numeral 1 shows a main spindle for grinding commutators, which is provided at its front end with a holder 4 for embracing or holding a grinding stone 2 of an insulating material or a transverse feeding mechanism 3 for a grinding stone. The main spindle 1 is slidably fitted within a guide sleeve 5, serving as a frame, so as to be movable towards and away from the surface of the commutator. On the back end or upper end of the guide sleeve 5 a holding frame or housing 7 is threadably engaged and carries a cutting or grinding feeding mechanism 6 for adjusting the grinding feed at the surface of the commutator. Secured to the sidewalls of the holding frame or housing 7 are support plates 8, between which a support shaft 10 is rotatably journalled and which extends transversely of the guide sleeve 5 and is provided at its mid portion with a worm 9 fixed thereto and at its extended end with a handle 11 for manual rotation. A worm gear 12 adapted to be in mesh with the worm 9 is fixed by means of a key to a shank or upper end of a threaded rod 13 provided coaxially with respect to the main spindle for feeding it. The rod 13 is rotatably supported in the holding frame 7 by means of rings 14 in the form of a trapezoid in crosssection and bearings 15 and is supported by means of an upper cover 16 threadably fitted in the holding frame 7 against the grinding resistance in an axial direction of the main spindle 1. The rod 13 for feeding the main spindle 1 is formed on its lower portion with a square thread 17 engaging an internal thread 19 formed in the inner wall of the cavity 18 of the main spindle 1 for finely feeding the main spindle in its axial direction. In the illustrated embodiment, the worm 9, worm gear 12 and rod 13 are so designed that the main spindle 1 will advance approximately 0.01 in. (about 0.25 millimeters) for one revolution of the handle 11.

The main spindle is formed along its outer surface with a key way 21 adapted to receive a slide key 22 extending into the interior of the guide sleeve 5, permitting axial movement of the main spindle 1 and preventing it from rotating relative to the guide sleeve 5.

Figure 2:
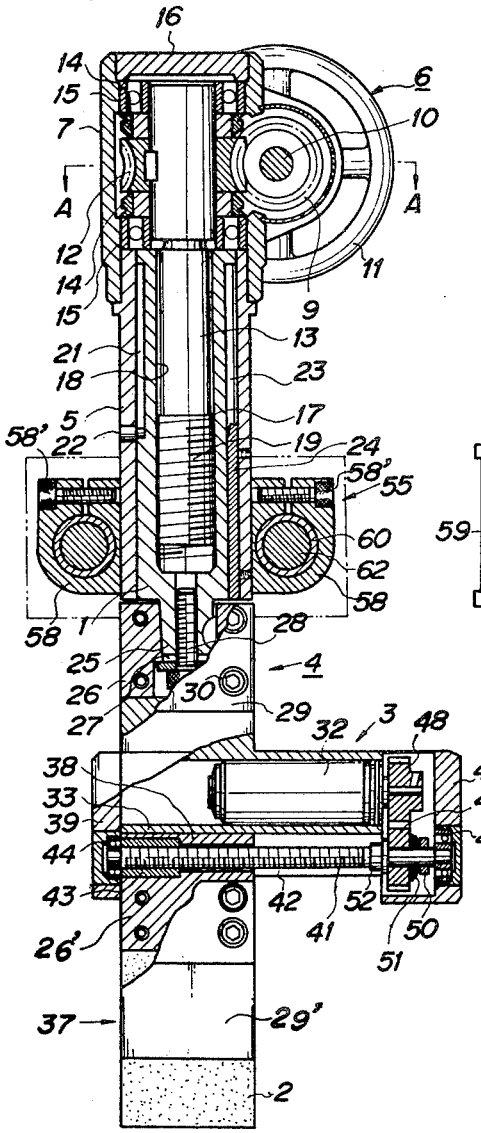
FIG. 2 is a longitudinal sectional view of the apparatus shown in FIG. 1.
Figure 3:
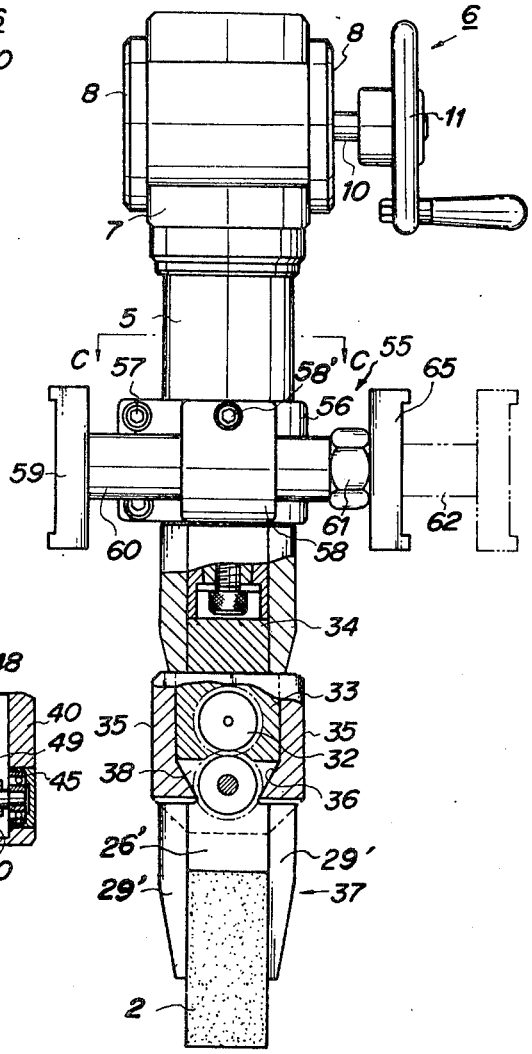
FIG. 3 is a side view, partially broken away, of the apparatus shown in FIG. 1.

As shown in FIG. 2, the main spindle 1 is formed on its outer surface with a groove 23 in its axial direction diametrically opposed to the key way 21. Within the groove 23 is snugly and slidably fitted a contact key 24 made of a plastic material, such as nylon, having a tapered section which is adapted to be anchored to the main spindle 1 by means of adjusting screws threadedly engaged in screw threaded holes in the guide sleeve 5 thereby adjusting the contact between the main spindle and the contact key 24 to prevent the main spindle from wandering due to the play therebetween.

Figure 10A:
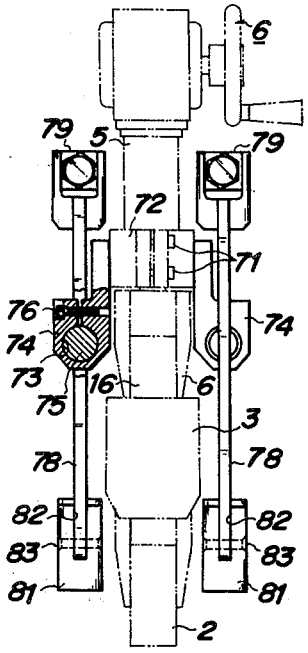
FIGS. 10 (*a*) and (*b*) are side and front elevation views of a modified clamping mechanism, respectively.
Figure 10B:
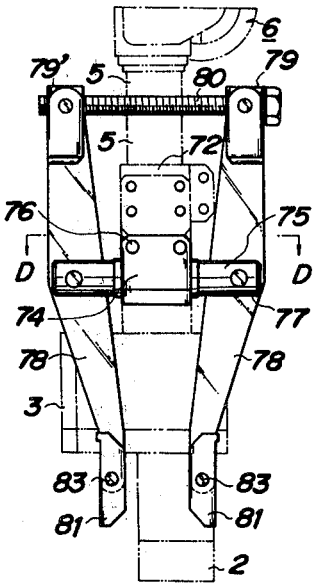
Figure 10C:
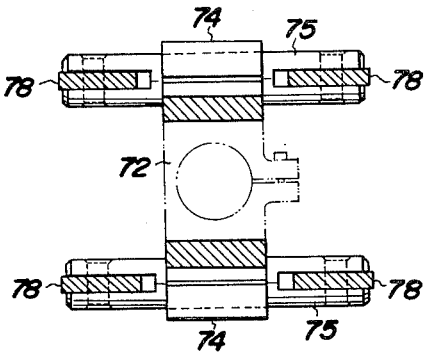

The main spindle 1 is provided at its lower or front end with a tapered connecting projection 25, which is fitted a tapered hole 27 of a fitting 26 of the holder 4 for the grinding stone. The fitting 26 is securely fixed to the protrusion 25 of the main spindle 1 by means of a flanged bolt 28 threadably engaged in a female screw formed in the projection of the main spindle. On opposite sides of the fitting 26 there are provided grinding stone restraining plates 29 of an insulating material detachably bolted thereto by means of bolts 30, which are normally two or four in number, to rigidly embrace a cubical grinding stone 2 of the insulating material as shown in FIG. 10.

Figure 11:
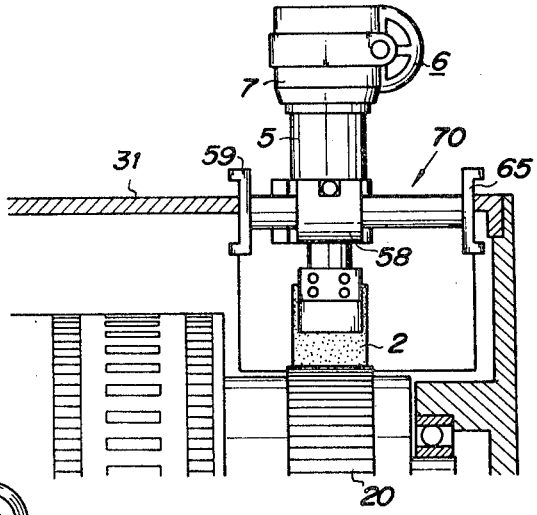
FIGS. 11, 12, and 13 are explanatory views showing operating conditions of the respective embodiments of the apparatus mounted at an opening of a casing of a motor according to the invention, respectively.
Figure 12:
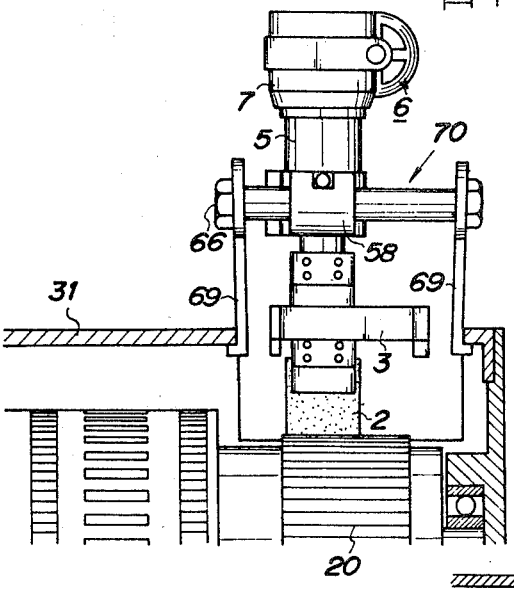
Figure 13:
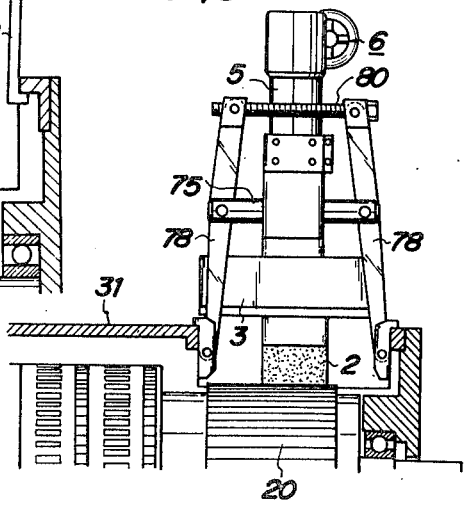

A clamping mechanism 55 for installing the grinding apparatus in an opening 70 of a casing of a motor will be described referring to FIGS. 5, 6, 7, 8 and 9. A fixture or main clamp 56 in the form of a split ring encircles the guide sleeve 5 in the axial direction of the sleeve 5 and is adapted to be clamped thereto by means of a bolt 57. The main clamp 56 is provided with diametrically opposed outwardly extending subclamps or protrusions 58 each formed with a channel within which is fitted a sleeve 60 extending in a direction at right angles to the main spindle. Each sleeve 60 is fixed to the main clamps 56 by means of a bolt 58' and provided at its end with an engaging plate 59 threadedly fixed thereto. An expanding threaded rod 62 has one end slidably inserted into a bore of the sleeve 60 and threadedly fitted with a nut 61 and the other end provided with an engaging plate 65 concentrically fixed thereto by means of a bolt 66 threadedly secured to the expanding threaded rod 62. A slide key 64 extending into the interior of the sleeve 60 is fitted in an elongated groove 63 of the threaded rod 62 and prevents it from dropping out of the sleeve 60 while permitting the axial sliding movement of the rod 62. When the nut 61 is rotated, the expanding threaded rod 62 will extend outwardly to urge the engaging plates 59 and 65 against respective opposed edges of an opening in the casing of the motor so that the apparatus is rigidly clamped at the opening 70 (FIGS. 11 and 12) of the casing at four locations in a plane perpendicular to the axis of the apparatus.

When a wide commutator is ground, the transverse feeding mechanism 3 is provided on the holder 4 for the grinding stone at the end of the main spindle in order to move the grinding stone in a direction parallel to the axis of the commutator. The transverse feeding mechanism 3 comprises an elongated frame 33 having a square crosssection and provided at the upper portion with a connecting projection 34 fitted within the holder 4. Bolted along the elongated opposite sides of the elongated frame 33 are side guide plates 35 which have lower ends extending inwardly toward each other to form a dovetail guide groove 36. The plates 35 are provided at their ends with face plates 39 and 40 fixed thereto. Within the dovetail groove 36 is slidably fitted an upper sliding portion 38 in the form of a dovetail in crosssection of a fixture 26' for a holder 37 for the grinding stone. Clamping plates 29' are fixed to both sides of the fixture 26' by means of a plurality of bolts for releasably holding the grinding stone embraced therebetween.

In order to reciprocally move the holder 37 along the guide dovetail groove 36, a micromotor 32 is housed in the elongated frame 33, and has a reduction device integrally provided on the micromotor, whose output is provided with a driving gear 48 in mesh with a driven gear 49 freely rotatably provided on a transversely feeding threaded rod 41 threadedly passing through the upper sliding portion 38 of the holder 37 for the grinding stone and rotatably journalled between the face plates 39 and 40. The driven gear 49 is urged against a shoulder 52 of the threaded rod 41 by means of a nut 50 threadedly engaged with the rod 41 and a cup washer 51 held by the nut 50 to produce a frictional force between the driven gear 49 and the rod 41 for driving it. When the holder 37 for the grinding stone reaches the face plate 39 or a stepped portion of the rod 41, the frictional resistance between the internal thread of the sliding portion 38 and the threaded rod 41 overcomes the frictional force between the driven gear 49 and the rod 41 so that the rotation of the rod 41 is stopped but the driven gear 49 continues its idling rotation. At that moment, a switch (not shown) arranged at a suitable location is changed over to reverse the rotation of the micromotor 32 resulting in a return movement of the holder 37 for the grinding stone for smoothly finishing the surface of the commutator.

With the above arrangement, if the axis of the transverse feeding mechanism 3 is not parallel with the commutator, by loosening the bolts 30 of the holder 4 the angle of the connecting projection 34 embraced between the holding plates 29 relative to the axis of the commutator can be adjusted to bring the axis of the mechanism 3 parallel to the commutator.

In another embodiment of the invention, limit switches may be provided at the face plates 39 and 40 so that the holder 37 for the grinding stone is automatically stopped at its extreme positions and is also automatically returned in a reverse direction by means of change-over switches.

Figure 7:
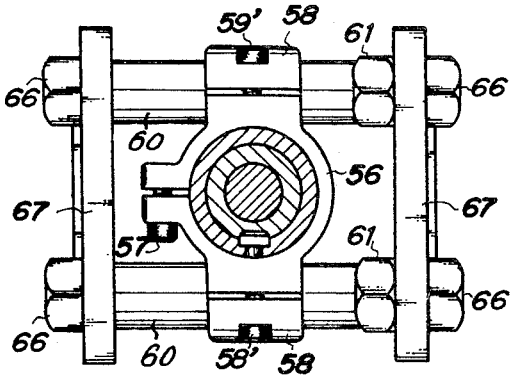
FIG. 7 is a plan view of a modified clamping mechanism.
Figure 8:
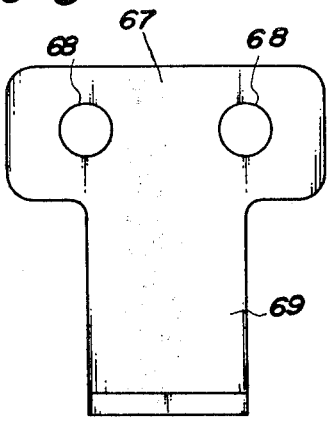
FIGS. 8 and 9 are front elevation and side views of the engaging support plate used in the clamping mechanism shown in FIG. 7, respectively.
Figure 9:
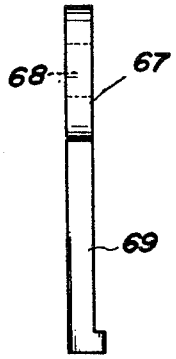

FIGS. 7, 8 and 9 illustrate another embodiment of the engaging plates 59 and 65, wherein there is shown a supporting plate 67 in the form of a substantially T-shaped plate which is used when a commutator 20 is adjacent to the opening of the casing or the transverse feeding mechanism for the grinding stone is required. One supporting plate 67 is bolted to the expanding threaded rods 62 by means of bolts 66 passing through apertures 68 of the plate 67 and another supporting plate 67 is bolted to the sleeves 60 by means of bolts 66 threadedly engaged with internal threads of the sleeves. Depending portions 69 of the supporting plates 67 are urged against the opening 70 of the casing to mount the apparatus thereto rigidly.

Another embodiment of the clamping mechanism is illustrated in FIGS. 10 (*a*), (*b*) and (*c*). The guide sleeve 5 is encircled by a main clamp 72 in the form of a split ring releasably clamped by bolts 71. The main clamp 72 is provided on its outer opposite surfaces with subclamps 74 extending downwardly and formed with respective passages 73. Supporting rods 75 pass through the passages 73 in a direction perpendicular to the axis of the main spindle and are adapted to be clamped at adjusted positions by means of bolts 76. Each support rod 75 has yoke ends 77, between the legs of which is pivoted a mid portion of each arm 78 pivotally movable in a transverse direction.

The arms 78 are provided at their upper ends with trunnions 79 and 79′. An elongated bolt 80 extends slidably through the trunnion 79 and has one end threadedly engaged with the trunnion 79′. By rotation of the elongated bolt 80, the upper ends of the arms 78 move toward each other to force the lower ends of the arms away from each other. An engaging plate 81 is pivoted to the lower end of each arm 78 by means of a pin 83 passing through a slit portion 82 of the lower end of the arm 78. Since the position of the arm 78 can be set by positional adjustment of the main clamp 72, the grinding apparatus can be securely mounted in a desired position even if the opening 70 is adjacent to the surface of the commutator or the transverse feeding mechanism for the grinding stone is located at the end of the main spindle.

It is understood by those skilled in the art that the foregoing description is for preferred embodiments of the invention and that various changes and modifications may be made without departing from the spirit and scope thereof.

What is claimed is:

1. A grinding apparatus for reforming a surface of a commutator of a motor comprising a guide sleeve, a main spindle slidably movable in said guide sleeve, feeding adjustment means on said sleeve for fine adjustment of movement of the spindle in the sleeve for adjusting the cutting depth of the main spindle relative to the commutator, holder means mounted on said main spindle for mounting a grinding stone, and clamping means mounted coaxially on said main spindle for installing the apparatus in an opening of a casing of the motor, said clamping means comprising a main clamp positionally adjustable relative to said guide sleeve and having opposite sides, subclamps releasably mounted on both sides of said main clamp and having respective channels, a sleeve fitted in each said channel and having ends with engaging plates thereat, and an expanding threaded rod having a nut slidably inserted in each said sleeve and an end supporting said engaging plate, whereby rotation of said nut causes said expanding threaded rod to extend outwardly to forcedly engage said engaging plate against the opening of the casing of the motor.

2. A grinding apparatus as claimed in claim 1, wherein said holder means comprises a transverse feeding mechanism for the grinding stone, said transverse feeding mechanism comprising an elongated frame having a lower portion with a guide groove, a holder for the grinding stone having a sliding portion slidably movable in said guide groove, a threaded transverse feeding rod threadedly passing through said sliding portion of said holder and extending in said guide groove parallel to said elongated frame, and driving means for rotatively driving said threaded rod in normal and reverse directions.

3. A grinding apparatus for reforming a surface of a commutator of a motor, comprising a guide sleeve, a main spindle slidably movable in said guide sleeve, feeding adjustment means on said sleeve for fine adjustment of movement of the spindle in the sleeve for adjusting the cutting depth of the main spindle relative to the commutator, holder means mounted on said main spindle for mounting a grinding stone, and clamping means mounted coaxially on said main spindle for installing the apparatus in an opening of a casing of the motor, said clamping means comprising supporting rods positionally adjustable on opposite sides of said sleeve and extending in a direction perpendicular to said main spindle, arms pivotally mounted at mid portions thereof on ends of said supporting rods and extending parallel to said main spindle, and bolt means interposed between upper ends of said arms for causing said arms to move away from each other and be forcedly engaged in said opening of the casing of the motor when the bolt means is rotated.

4. A grinding apparatus as claimed in claim 3, wherein said holder means comprises a transverse feeding mechanism for the grinding stone, said transverse feeding mechanism comprising an elongated frame having a lower portion with a guide groove, a holder for the grinding stone having a sliding portion slidably movable in said guide groove, a threaded transverse feeding rod threadedly passing through said sliding portion of said holder and extending in said guide groove parallel to said elongated frame, and driving means for rotatively driving said threaded rod in normal and reverse directions.

5. A grinding apparatus for reforming a surface of a commutator of a motor, comprising a guide sleeve, a main spindle slidably movable in said guide sleeve, feeding adjustment means on said sleeve for fine adjustment of movement of the spindle in the sleeve for adjusting the cutting depth of the main spindle relative to the commutator, holder means mounted on said main spindle for mounting a grinding stone, clamping means mounted coaxially on said main spindle for installing the apparatus in an opening of a casing of the motor, a contact key having a tapered section snugly fitted within a longitudinal groove provided in an outer surface of said main spindle, said key being adjustable in said guide sleeve, and screw means for adjusting the contact key in the longitudinal groove for preventing wandering of said main spindle.

6. A grinding apparatus as claimed in claim 5, wherein said holder means comprises a transverse feeding mechanism for the grinding stone, said transverse feeding mechanism comprising and elongated frame having a lower portion with a guide groove, a holder for the grinding stone having a sliding portion slidably movable in said guide groove, a threaded transverse feeding rod threadedly passing through said sliding portion of said holder and extending in said guide groove parallel to said elongated frame, and driving means for rotatively driving said threaded rod in normal and reverse directions.

* * * * *